United States Patent [19]

Davis

[11] Patent Number: 4,872,511

[45] Date of Patent: Oct. 10, 1989

[54] FIRE EXTINGUISHING APPLIANCE AND APPENDED SUPPLEMENTARY APPLIANCES

[76] Inventor: Charles B. Davis, Hochstrasse 24, D4400 Münster, Fed. Rep. of Germany

[21] Appl. No.: 40,393

[22] Filed: Apr. 13, 1987

[30] Foreign Application Priority Data

Jan. 26, 1987 [DE] Fed. Rep. of Germany ..... 3711774

[51] Int. Cl.[4] ..... A62C 1/00; A62C 35/00; A62C 35/52

[52] U.S. Cl. ..... 169/12; 169/44; 169/45; 169/46; 169/70; 169/15

[58] Field of Search ..... 169/12, 51, 43–47, 169/54, 56, 60, 61, 70, 11, 14, 19, 91, 15, 9, 13

[56] References Cited

U.S. PATENT DOCUMENTS

| | | | |
|---|---|---|---|
| 2,259,501 | 10/1941 | Smith | 169/12 |
| 2,283,775 | 5/1942 | Thompson | 169/46 |
| 2,498,512 | 2/1950 | Thompson | 169/12 |
| 2,560,091 | 7/1951 | Davis | 169/70 X |
| 3,403,733 | 10/1968 | Terry | 169/12 X |
| 3,407,880 | 10/1968 | Davis | 169/12 |
| 3,463,234 | 8/1969 | Van Baak | 169/12 X |
| 3,692,118 | 9/1972 | Yao | 169/12 X |
| 3,708,015 | 1/1973 | Yao | 169/12 |
| 3,780,811 | 12/1973 | Yao | 169/12 X |
| 3,826,313 | 7/1974 | Yao | 169/12 X |

FOREIGN PATENT DOCUMENTS

| | | | |
|---|---|---|---|
| 2730396 | 5/1979 | Fed. Rep. of Germany | 169/12 |
| 1267200 | 3/1972 | United Kingdom . | |

*Primary Examiner*—Joseph F. Peters, Jr.
*Assistant Examiner*—James M. Kannofsky

[57] ABSTRACT

Fire extinguishing devices are designed to extinguish specific classes of fires. Fire extinguishing streams are being planned and being fixed to combat a kind of fire in a fixed state of burning. The invention, a venturi activated tube extinguishes fire in its changing states of burning, in its stages of development and composition. The ejector tube is designed to discharge extinguishing streams with sonic velocities continuously counterbalanced by suction flows at sonic speed along the center axis of the hollow tube. The heat of the damaging fire regulates the densities of the unified discharge and suction flows. Combined forces of pressure and suction increase the capacity of this invention to combat fire. The ejector tube is self-adjusting and self-cleaning. The ring orifice reacts under overthrust pressures to discharge flow obstructing solids automatically.

5 Claims, 3 Drawing Sheets

FIRE EXTINGUISHING APPLIANCE AND APPENDED SUPPLEMENTARY APPLIANCES

This invention relates to a fire control system and fire extinguisher for installation and use in any compartment, room, or area where there is a fire hazard or where a damaging fire may occur, such as in buildings, engine rooms, paint lockers, et cetera, whether on land or on air, land, or water vehicles.

One of the objects of the invention is the provision of a more efficient fire control system than heretofore which dissociates damaging fire which conducts the constituents of a damaging fire through fire extinguishing spaces and appliances under force generated by a Laval-orifice-ring, which discharges fire extinguishing fluids into an area of damaging fire at pre-analyzed optimal densities and velocities.

Another object of the invention, is the provision of an improved fire extinguisher to discharge under pressure fire extinguishing agents at optimal velocities and densities which the temperatures of the damaging fire require, through and out of a Laval-orifice-ring.

Another object of the invention is the provision of a Laval-ring-orifice which instantaneously adjusts discharge areas to admit and to emit fire extinguishing agents at sonic or supersonic speeds.

Another object of the invention is the provision of a Laval-orifice-ring which absorbs, distributes and utilizes heat and energy of a damaging fire to increase the discharge-suction force of said Laval-orifice-ring over the capacity of the power driven fire control system.

Another object of the invention is the provision of a Laval-ring-orifice which distributes the heat of the damaging fire into fire extinguishing agents to regulate thermodynamically relative density to discharge velocity out of the Laval-orifice-ring to permit supersonic emissions.

A still further object of the invention is the provision of a Laval-ring-orifice which is self-cleaning, which expands and opens self-adjusting under the percussion of rapid flow-pressure changes in the fire extinguishing agent supply lines to release dirt or ice or an obstruction which interrupts proper ejection.

Heretofore the implement generally applied for fire fighting within substantially enclosed spaces is the conventional straight nozzle or a form of round-tipped pipe opening.

A single straight nozzle group arranged in a kind of "injector structure" sets circulatory forces in action to support the normal fire extinguishing emissions out of straight tipped spouts. This means for fighting fires is described by U.S. Pat. Nos.:

2,259,501
2,283,775
2,358,199
2,498,512 and defined by the teachings of Frank B. Allen, James B. Smith, and Norman Thompson.

The U.S. Pat. Nos., Davis:

2,560,091
3,407,880 disclose fixed ring-formed orifices. The aperture of such orifices must be adjusted and fixed by hand. Each adjustment of orifice area allows fire fighting with a limited group of and a limited number of fire extinguishing agents to extinguish a damaging fire with efficient discharge-suction action at sonic speeds within a range of transistory temperatures of a damaging fire. Other groups of fire extinguishing agents are subject to subsonic discharge velocities at the above fire temperatures which react with reduced fire extinguishing suction efficiency or loss of suction action.

The spout or nozzle is not a high velocity discharge instrument. All fluids and gases powder-off in uncontrolled side spray at sonic speeds. Spouts or nozzles grouped in an "injector structure" cannot force a controlled fire extinguishing agent discharge, cannot force suction-action, and cannot force control over the gaseous masses of a damaging fire.

Therefore, the provision of a fire extinguishing appliance of air injector design, equipped according to the teachings of Laval with a ring orifice which expands to allow the discharge of fluid fire extinguishing agents at sonic speeds with sonic speed discharge-suction reaction, is a special object of the invention to change the air within a ship, room, or compartment to the point where it will not support combustion and to protect the ship, room or compartment structure from said products of combustion, including unburned or partially burned solids.

Other objects and advantages will appear in the description and the drawings.

Figure 1:
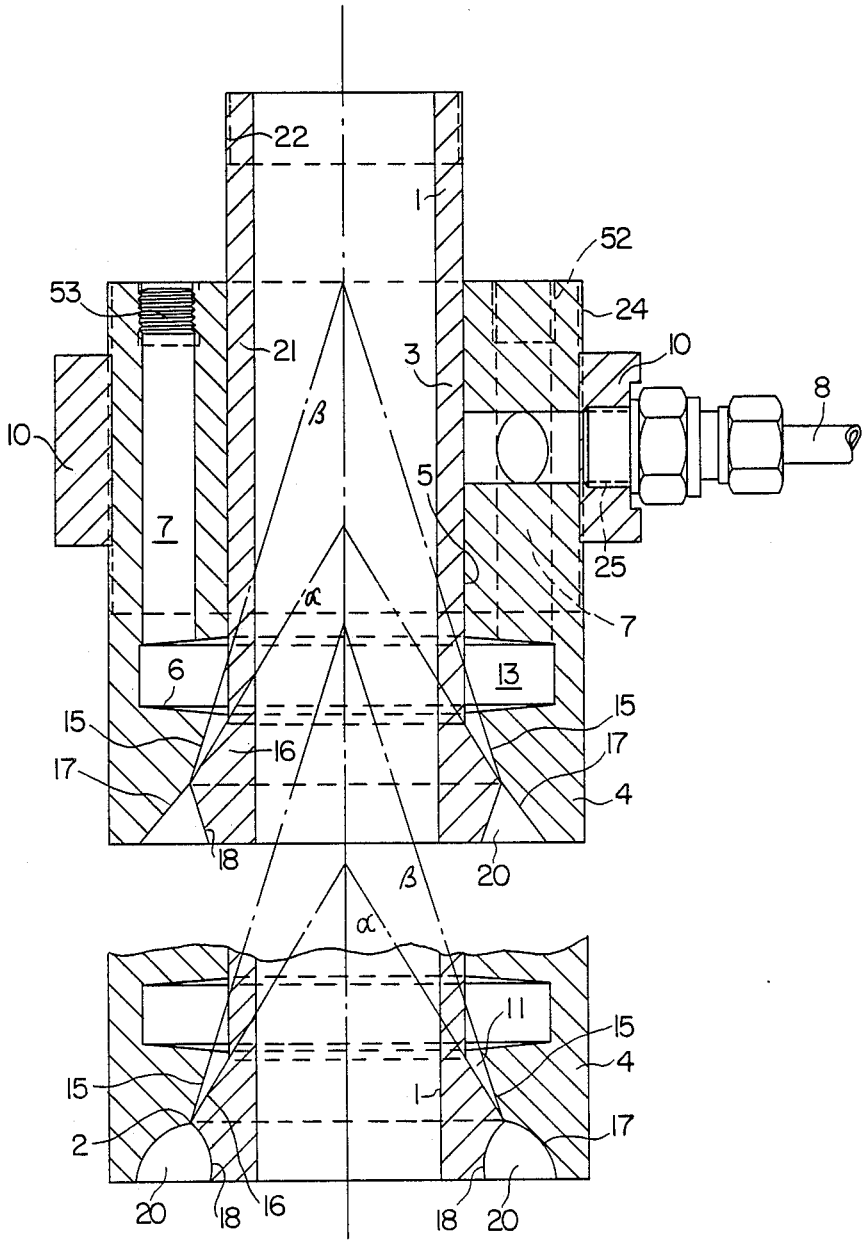
FIG. 1 is a sectional view through an extinguisher illustrating the present invention; below is an alternative discharge orifice.
Figure 2:
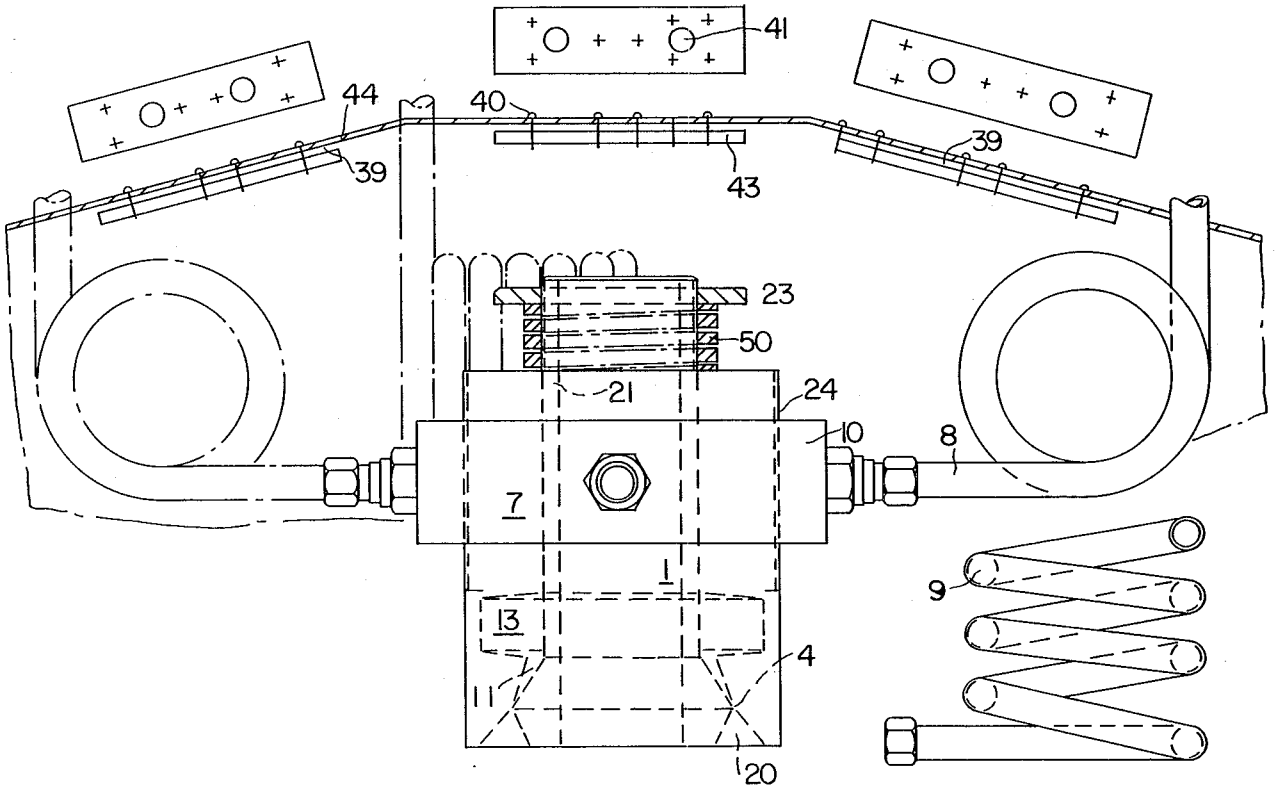
FIG. 2 is a semi-diagrammatic view illustrating the present invention assembled with shield in position as fire fighting appliance, with part a cross-sectional view and the top part a plan view of the powder blocks.
Figure 3:
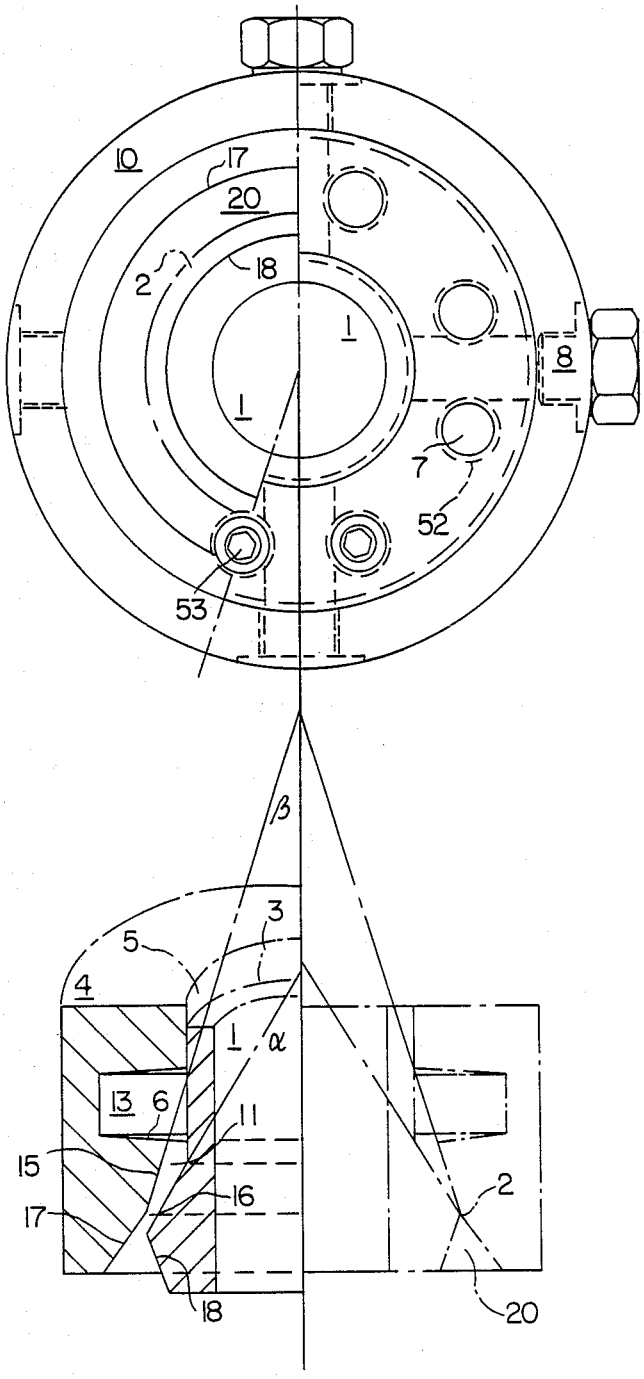
FIG. 3 illustrates the present invention; top right is a top view of the extinguisher, top left is a bottom view of the fire extinguisher with closed injector opening; bottom right is a diagrammatic view of the lower part of the fire extinguisher with closed injector opening, and bottom left is a detailed sectional view of the ring-formed discharge orifice with open injector opening.

In detail, referring to FIGS. 1, 2, and 3, a straight sided, open ended, central tube generally designated as 1, is provided. While the fire extinguisher may be disposed in any position most suitable for accomplishing its intended results, for the purpose of description it is shown in FIGS. 1, 2, and 3 with the tube 1 in vertical position, in which the upper end of the tube 1 is the inlet thereto, and the lower end the outlet.

Around and coaxial with the tube 1 is an annular body 4 having an inner annular surface 5 fitted axially around an outer surface 3 of the tube 1. The cylindrical surfaces "3 and 5" are slide-action surfaces which guide an upper part 21 of the tube 1 within a running fit.

The annular body 4 embodies a pressure chamber 13 within an annular recess which opens outwardly around facing the surface 3 of the tube 1. Upper and lower walls 6 which slant towards the center axis form a circular duct, the pressure chamber 13. The lower wall 6 is slanted downwardly and outwardly to the axis; the upper wall 6 is slanted upwardly and outwardly to the axis. The upper wall 6 is formed with passageways 7, evenly spaced in pairs within the annular body 4 to supply concentric annular connections to the pressure chamber 13. While eight passageways 7 and 4 pressure lines 8 are indicated in the drawings, their numbers may vary. The upper openings of the passageways 7 are tapped with threads 52 and are plugged with threaded plugs 53. The lower wall 6 of the pressure chamber 13 connects an outwardly tapered conical inner surface 15 of the annular body 4 to an injector opening 11. The conical inner surface 15 spreads radially complementary to an outwardly tapered conical outer surface 16 of the tube 1 to form injector opening 11. The conical outer surface 16 of the tube 1 and the conical inner surface 15 of the annular body 4 in juxtaposition describe conical angles $\alpha$ and $\beta$. Whereby the axial angle $\alpha$ is greater than the axial angle $\beta$. The conical inner surface 15 within the lower part of the annular body 4 and the conical oblique outer surface 16 of the tube 1 intersect in ring orifice 2, annularly to close and to control the size of ejector opening 11.

The size of the ring orifice 2 is enlarged conically circumscriptively by a conical outer surface 18 of the tube 1 and by a conical inner surface 17 of the annular body 4 as Laval orifice. The enlargement terminates in a ring-formed discharge orifice 20 which is much greater in size than the orifice ring 2 in order to afford side-spray-free fire extinguishing agent discharges at sonic speeds. The conical surfaces "17 and 18" may be straight or curved, or one straight and one curved.

The size of the ring orifice 2 and the flow capacity of the discharge orifice 20 are pressure regulated and self-adjusting.

The conical axial angles $\alpha$ and $\beta$ determine the depth and the operational scope of fire extinguishing agent discharge; sloped axial angles $\alpha$ and $\beta$ have greater fire extinguishing scopes; conical axial angles $\alpha$ and $\beta$ with lesser divergence from the center axis reach a damaging fire at greater depths.

The flow through the injector opening 11 and the pressure in discharge orifice 20 automatically set the ring orifice 2 to equalize the pressure in pressure chamber 13 against the pressure exerted by steel springs 50. Controlled changes in driving pressures and in discharge volumes in the pressure lines 8 open, regulate and shut off the ring orifice 2 with the injector opening 11. Continuously controlled changes in driving pressures and in the kinds and volumes of driving fire extinguishing agents, continuously measured out and applied, result in driving-suction discharges of fire extinguishing agent and products of combustion which are equally and uniformly forced to the base of the damaging fire.

The working pressure in the pressure lines 8, conducted through the passageways 7 into the pressure chamber 13, aligns the surfaces "3 and 5" in slide-action, presses the conical divergent surfaces "15 and 16" apart and opens the ring orifice 2 around the injector opening 11. High working pressures in the pressure lines 8 deliver large fluid capacities at high powered sonic discharge velocities (markedly, when high pressures in the pressure lines 8 are reinforced by high temperatures in the tube (1); less working pressure in the pressure lines 8 reduces the volume of the fire extinguishing stream and the discharge pressure; at lower pressures in the pressure lines 8, the steel springs 50 close the injector opening 11 around the ring orifice 2 to shut off the discharge orifice 20.

A threaded adjustment ring 23 assembles the tube 1, the steel springs 50 and the annular body 4 in an unit. An upper part 21 of the tube 1 extends over the annular body 4 and is threaded in element 22. The threaded adjustment ring 23 adjusts the pressure of the steel ring 50 upon the upper surface of the annular body 4. The pressure exerted by the steel springs 50 upon the annular body 4 suspends the forces reacting within the pressure chamber 13.

The discharge capacity of the discharge orifice 20 coupled within the size of the injector opening 11, is equivalent to the pressures in the pressure chamber 13 and the pressure exerted by the steel spring 50.

A manifold collar 10 is threadedly secured to the annular body 4. A full inside thread of the manifold collar 10 threads into an upper outside thread 24 threaded on the upper part of the annular body 4. Tap holes 26 of the threads 25 extend radially through the annular body 4 to join the passageway 7 pairs. The pipe fittings of the pressure lines 8, evenly spaced in the threads and tapped holes "25 and 26", lock the collar 10 to the annular body 4 in flow position into the passageways 7.

A shield 44 arched over the tube 1 directs a damaging fire horizontally into sub-burn-out spaces 39, through holes 41 in fire extinguishing chemical powder blocks 43 in the burn-out space 38. The burn-out space 38 allows a damaging fire to burn out, to consume solid particles, and to circulate under the control of the suction forces exerted by the tube 1. The powder blocks 43 which control heat and fire under the shield 44, consist of chemical fire extinguishing powder formed into porous block units which are reinforced with wire mesh and pierced with holes 41. The powder blocks 43 are installed with long pins 40 spaced downwardly from the shield 44 to allow free circulation of the damaging fire in the sub-burn-out spaces 39 underneath the shield 44 and between the powder block 43 units.

The manifold collar 10 joined and fitted to the pressure lines 8 secures the fire fighting invention in permanent operating position to protect a ship, a room or compartment against damaging fire. More than one unit of the fire extinguisher may be required to protect a structure and contents.

Joined and fitted in the pressure lines 8 are pressure pipe spirals 9 to exchange heat out of the damaging fire into driving energy in the pressure lines 8. The shield 44 and the pressure lines 8 and the pressure pipe spirals 9 absorb and transmit heat in order to increase the driving-suction power of the tube 1 in combined heat exchanging reaction which is an object of the fire fighting invention. In operation, assuming a fire commences within the area toward which the discharge end of the tube 1 is directed, the first-choice fire extinguishing agent starts up fire extinguishing action at first-choice driving pressure in the pressure lines 8, (Explanatory provisional choice and selection table of fire fighting means to be used with the invention:

| | |
|---|---|
| Choice Number | |
| Temperature in the axis of tube 1 | Transitory |
| degree Centigrade | temperatures of |
| degree F.° | damaging fire |
| | C.° F.° |
| | fire extinguishing agent |
| | gas |
| | liquid |
| | mixed |
| | Discharge pressure at 20°C./100° F. |
| | bar psi |
| | Discharge volume at atmospheric pressure $ft^3$ |
| | $m^3$ |
| Terminal temperature in the axis of tube 1 | Density and temperature of |
| °C. | fire extinguishing agent |

-continued

| | | |
|---|---|---|
| °F. | | at atmospheric pressure |
| Terminal transitory temperature of fire | | at the driving machine |
| | change to | cylinder |
| Choice | keep | |
| | stop action | compressor<br>pump<br>tandem parallel |

An informative "choice table" gives the basis for the continuous precise operation of the invention. Electronic "tell tales" to transmit and record data from the damaging fire are necessary.

Choice table examples (simplified)

| Fire extinguishing agent | Discharge pressure Suction pressure | Temperature tube 1 |
|---|---|---|
| Steam ($H_2O$) | 10 bar/0.2 bar | 20° C.-50° C. |
| Water ($H_2O$) | 100 bar/0.2 bar | 1000° C.<br>1800° F. |

Steam ($H_2O$) is first choice fire extinguishing agent in the example; water ($H_2O$) is a last choice fire extinguishing agent in the example; steam and water discharges in the example reach sonic discharge velocities.) The driving machinery, cylinders, compressors, pumps activate the fire extinguisher; the first choice fire extinguishing agent flows out of the pressure chamber 13 into the injector opening 11, over the Laval surfaces "17 and 18" out of the discharge orifice 20. Electric-, pneumatic-, hydraulic servomechanism release, start, set and adjust fire extinguishing agent driving machinery, pressure cylinders, compressors, and pumps to a first choice discharge velocity, discharge volume, and discharge pressure. Discharge velocities may be subsonic or sonic in choice. Hand operated controls, auxiliary for servomechanisms, are provided for in case of power failures.

The size of the ring orifice 2 on the injector opening 11 is governed by the prssure in the pressure lines 8; the discharge volume, the specific density and the viscosity of the fire extinguishing agent fluid are determined by the impulse signals from pyroelectronic and pyroelectric sensors which compile fire extinguishing agent choice-table data to activate the corrrelating selector valves in the servo-mechanisms of the driving machinery.

The force of fire extinguishing agent discharge and the force of suction in the tube 1, regulated with driving pressures, exact fire extinguishing agent densities and discharge velocities which are reached through choice-table data from pyroelectric sensors, combine in an impelling force to fight fire.

Pyroelectric and pyroelectronic sensors and infra-red indicators detect, indicate and register heat, smoke, flames, radiation, and temperatures within the tube 1, in the discharge stream out of the discharge orifice 20, in the shield 44, and within the sphere of the damaging fire in order to seek a choice-table fire extinguishing agent with choice-table density properties and velocity and capacity of discharge out of the orifice 20. The sought out, choice-table fire extinguishing agent controls the circulation of the damaging fire under the best possible conditions with combined, optimized suction and discharge forces to extinguish the damaging fire.

The discharge of fire extinguishing agents over the expanded surfaces "17 and 18" out of the discharge orifice 20 at sonic speeds follows the Laval-Law for the discharge of fluids at sonic velocities. A sonic discharge of fluids out of the discharge orifice 20 produces a partial vacuum along the axis of the tube 1 which controls the flow of hot gases under the shield 44 and sucks smoke and flames into and through the tube 1. The suction forces along the axis of tube 1 induce large correlated volumes of heated air and gases through the sub-burn-out spaces 39, conduct the products of combustion through the burn-out space 38, and force the damaging fire through the tube 1 into the driving fire extinguishing agent between the Laval-conical surfaces "17 and 18" on to the discharged stream out of the discharge orifice 20. In addition, the suction forces along the tube 1 draw the fire retarding decomposing products out of the powder blocks 43 through the tube 1.

The pressure lines 8 are hooked up to fire extinguishing agent driving machines, compressors, pumps, and pressurized cylinders. Fire extinguishing agents, multiple in kinds, properties, densities, specific weights, and initial pressures, supply the above power units with choice-fire extinguishing agents out of the choice-table. Impulse signals out of the fire sensors select the choice-fire extinguishing agent and deliver the choice-fluid into the pressure lines 8 at choice-pressure through the selector valve servomechanisms. Mixed fire extinguishing agents are delivered into the pressure chamber 13 through the pressure lines 8; each one of the pressure lines 8 transports an ingredient of the mixture to be discharged out of the discharge orifice 20 as X-choice-fire extinguishing agent mixture.

Upon an inspection of structure and contents a selection of first-choice-means is made. A first-choice firre extinguishing agent is immediately available in the pressure lines 8, in volume and pessure at the first-choice driving unit to extinguish an incipient damaging fire without loss of contents from fire, smoke or fluids. In case of explosion or sudden large volumes of flames the second-choice or multi-choice decisions must be made. A second-choice or more-choice decision on the use of fire extinguishing-fluids, pressures, discharge volumes is the result of electronic fire sensors and infra-red detectors which read the temperatures of the damaging fire and the risk of further combustion and explosion at the discharge orifice 20, in the tube 1, within the shield 44, and within the sphere of a damaging fire, and transmit signal impulses to interpret the current course of the damaging fire. The signal impulses activate servomechanisms to shift the tube 1 into sonic velocity suction and sonic velocity discharge of optimum-choice-fire extinguishing agent out of the discharge orifice 20.

High powered fire extinguishing agent driving machinery coupled to thermodynamically exactly controlled flow is required to activate sonic discharge speeds and correlated continuous sonic speed suction of large volumes of vapors through and out of the tube 1. Discharge pressure, flow-discharge densities and temperatures, duly united in thermodyanmic state, concur to adjust the activated tube 1 to extinguish damaging fire at the highest possible efficiency. The conically diverging surfaces "17 and 18" progressively expanding the size of the ring orifice 2 and self-adjusting the discharge orifice 20 in conformance with the teachings of Laval, discharge hollow cylindrically formed sonic and supersonic fire extinguishing agent streams and induce continuous maximum suction along the axis of the tube 1.

The sonic speed discharge out of the Laval-formed conical discharge orifice 20 extinguishes, sonic suction generating, damaging fire at greater distances, at greater width than nozzles discharging side-spary-disturbed by sonic speed emissions. The superiority of the invention is provided for by advantages of the discharge orifice 20 with expanding surfaces which adjust to and are suited for high velocity discharges of fire extinguishing agents. The damaging fire burns out under favorable conditons during controlled circulation in the burn-out space 38, in the retarded flow through the sub-burn-out spaces 39, in the accelerated flow along the axis of the tube 1, and in the sonic velocity stream at the discharge orifice 20. Through the circulation of the gaseous mixtures of damaging fire within the confined or semiconfined spaces in a ship, compartment or structure is the air in the space quickly changed into a nonflammable, nonexplosive gaseous fluid with particles neutralized by fire. The combustible gases, smoke, sparks, and burning particles burn out and decompose the fire extinguishing powder blocks 43. The fire extinguishing agent discharge through the pressure lines 8 out of the discharge orifice 20, continuously replenished by the voluminous circulation of gas through the tube 1 as neutralized extinguishing gas, beats back flames and extinguishes the damaging fire progressively quicker and better.

The described fire fighting has the final advantage in an automatic fire extinguisher which continually progressively adjusts during the course of a damaging fire in all its stages and thermodynamic states to put it out. The automatic fire extinguisher fits itself into the thermodynamic state generated by the damaging fire for the purpose of giving better protection to the structure and contents where the invention is installed.

I claim:

1. A stationary fire extinguishing appliance to extinguish fire in enclosed spaces and areas by continually controlling and injecting heated air products of combustion through an open-ended passage within said area or space, by drawing in and returning said heated air and products of combustion to the base of a fire; identified by a hollow venturi tube having a longitudinal axis and by an adjustable orifice-ring on the end of said tube which allows discharge and suction fire extinguishing flows at sonic speeds; identified by said tube (1), which is axially shiftable along said axis, with a fire extinguishing agent conveying injector opening (11) having a cross-sectional area that is adjustable by said axial shifts of said tube (1), by suction spaces for the products of combustion which conduct burnt gas mixtures to the base of a fire under application of a secondary chemical extinguishing agent in powder blocks (43), through sub-burn-out spaces (39), in a burn-out space (38) along a shield (44) into the open passage of said tube (1) which is coaxially mounted in slide-action within an annular body (4) by steel springs (50) with a threaded adjustment ring (23) which regulate and offset the cross-sectional area of the injector opening (11), which is circular-formed, with a fire extinguishing agent which is driven and conducted through pressure lines (8) and a pressure chamber (13) and which controls with pressure the cross-sectional area of the circular-formed injector opening (11) with said opening (11) shut off at a lower, outer end of the tube (1) when the tube (1) is shifted axially, said outer end having a first, outer conical surface (16) which describes a first acute angle ($\alpha$), intersecting at a lower conical end of the annular body (4) which has a second inner conical surface (15) that describes a second acute angle ($\beta$), with the first acute angle ($\alpha$) is greater than the second acute angle ($\beta$) and with the second conical surface (15) and the first conical surface (16) in juxtaposition and the injector opening (11) is formed and is identified by the orifice ring, a diverging circular-formed discharge orifice (20) which has conical discharge surfaces that expand, said discharge surfaces are adjoining and are integrated in the adjustment shifts of the injector opening (11), which has conical discharge surfaces (17 and 18) that form an apex-adjustable, cleavable ring opening (2) which regulates the pressure and density of a driving fire extinguishing agnet, so that a venturi driving fire extinguishing agent in contact with the products of combustion drawn through the tube (1) reacts in pressure and density to incite sonic and supersonic speeds into venturi-activating as well as into suction-intake flows, so that the products of combustion are forcefully drawn out of the burn-out spaces (38 and 39) under the shield (44) through the tube (1) and so that the heat of the fire is transmitted into the driving fire extinguishing agent, onto the fire extinguishing stream of the venturi driving fire extinguishing agent, into all the fire inhibiting streams streaming through and out of the tube (1) in order to generate additional energy to fight fire.

2. Stationary fire extinguishing appliance identified in claim 1 and further defined by positioning heat-exchanging plumbing within a sequence of the flow of the fire over and through pressure pipe spirals (9) of said plumbing into the burn-out spaces (38 and 39) under the shield (44) into holes (41) of the chemical fire extinguishing powder blocks (43) in the sub-burn-out spaces (39) through the burn-out space (38) in order to change the heat of a fire into additional energy in the pressure lines (8) in order to energize and volatilise the fire extinguishing streams in, around, and passing through the tube (1).

3. Stationary fire extinguishing appliance defined in claim 2 and further defined by a plurality of driving fire extinguishing agents having a plurality of chemical consistencies and chemical properties of Venturi-driving fire extinguishing fluids which can activate the tube (1) for sonic and supersonic speed discharges.

4. Stationary fire extinguishing appliance defined in any one of claims 1, 2 or 3 and further identified by a self-cleaning capacity of the injector opening (11) through the discharge orifice (20) which extend and open in slide-action sufficiently wide to release dirt and ice which may obstruct the fire extinguishing stream of the driving fire extinguishing agent.

5. Stationary fire extinguishing appliance defined in any one of claims 1, 2 or 3 and further identified as a high velocity air-cleaner, the tube (1) being a forceful, self-adjusting venturi tube which neutralizes combustible, gaseous mixtures and explosive gases before, during, and after a damaging fire.

* * * * *